US009686030B2

(12) United States Patent
Holtman et al.

(10) Patent No.: US 9,686,030 B2
(45) Date of Patent: Jun. 20, 2017

(54) METHOD AND APPARATUS FOR CONFIGURATION AND CONTROL OF MIXER FOR AUDIO SYSTEM USING WIRELESS DOCKING SYSTEM

(71) Applicant: KONINKLIJKE PHILIPS N.V., Eindhoven (NL)

(72) Inventors: Koen Johanna Guillaume Holtman, Eindhoven (NL); Walter Dees, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 406 days.

(21) Appl. No.: 14/359,422

(22) PCT Filed: Nov. 9, 2012

(86) PCT No.: PCT/IB2012/056271

§ 371 (c)(1),
(2) Date: May 20, 2014

(87) PCT Pub. No.: WO2013/076611

PCT Pub. Date: May 30, 2013

(65) Prior Publication Data

US 2014/0301575 A1 Oct. 9, 2014

Related U.S. Application Data

(60) Provisional application No. 61/563,172, filed on Nov. 23, 2011.

(51) Int. Cl.
*H04H 60/04* (2008.01)
*H04R 3/12* (2006.01)

(52) U.S. Cl.
CPC ..... *H04H 60/04* (2013.01); *H04R 3/12* (2013.01); *H04R 2205/021* (2013.01)

(58) Field of Classification Search
CPC ..... H04R 3/12; H04R 2205/021; H04H 60/04
(Continued)

(56) References Cited

U.S. PATENT DOCUMENTS 5,768,126 A 6/1998 Frederick
5,890,017 A * 3/1999 Tulkoff ..... G06F 3/16 709/203

(Continued)

FOREIGN PATENT DOCUMENTS

WO W02013076625 A1 5/2013

OTHER PUBLICATIONS

"Float on Your Tunes of your Favorite Music in Every Corner of your Home", Activemania, May 18, 2011, www.activemania.com.

*Primary Examiner* — Davetta W Goins
*Assistant Examiner* — Daniel Sellers
(74) *Attorney, Agent, or Firm* — Larry Liberchuk

(57) ABSTRACT

Efficiency for mixing audio signals from one or more portable user devices in an audio system employing a number of docking station is achieved by a docking station that includes a controller for detecting the presence of an activated mixer associated with another docking station in the system. The controller activates its associated mixer when no activated mixer associated with another docking host in the system is detected. When its associated mixer is activated, the controller in the one docking station causes its associated mixer to be connected both to the audio sound system for supplying an input signal thereto and indirectly to the output(s) of the one or more portable devices. Transfer of mixing from one docking station to another in the same system upon the occurrence of a particularly defined event is also described.

16 Claims, 2 Drawing Sheets

(58) Field of Classification Search
USPC ..... 381/119, 77, 79, 80, 81, 82; 700/94
See application file for complete search history.

(56) References Cited

U.S. PATENT DOCUMENTS

| | | | | |
|---|---|---|---|---|
| 6,007,228 | A | 12/1999 | Agarwal | |
| 7,095,867 | B2 | 8/2006 | Schul | |
| 2003/0055518 | A1 * | 3/2003 | Aiso | H04H 60/04 700/94 |
| 2003/0121401 | A1 * | 7/2003 | Ito | G10H 1/0083 84/625 |
| 2005/0149215 | A1 | 7/2005 | Deshpande | |
| 2008/0304692 | A1 | 12/2008 | Zhang | |
| 2009/0238381 | A1 | 9/2009 | Morey | |
| 2011/0061108 | A1 | 3/2011 | Arrasvuori | |

* cited by examiner

METHOD AND APPARATUS FOR CONFIGURATION AND CONTROL OF MIXER FOR AUDIO SYSTEM USING WIRELESS DOCKING SYSTEM

The present invention relates generally to the field of wireless communications and, more particularly, to mixing audio signals from portable user devices together for reproduction by an audio system.

Docking allows a portable device to be coupled with a docking station. The coupling may occur via a wired connection or via a wireless connection. Docking stations, such as those commercially available for Apple iPods and the like, can be connected to or integrated with an audio system for reproduction of the audio signals output from the portable device docked physically or even wirelessly with the docking station. Even more recent versions of these docking stations are known in which, for a single docking station, multiple portable user devices, such as the Apple iPods, are capable of being physically docked so that their output audio signals and even output audio signals from external sources can be mixed together through the use of an integrated internal audio mixer or an external audio mixer. Examples of such a docking station can be seen in U.S. Pat. No. 7,095,867 to Schul et al. (docking station for single portable device and external audio source, station performs mixing via integrated audio mixer), U.S. Patent Application Publication No. 2009/0238381 for Morey (docking station for multiple portable devices, station performs mixing via integrated audio mixer), and in the technical literature published by ActiveMania concerning their aicoustic digital audio system (docking station for multiple portable devices, external audio mixer connected to station and to other external audio devices performs mixing).

The presence of audio mixing circuitry, whether separate from the docking station or internally integrated in the docking station, creates a need for a larger footprint for the audio system and an increased system power budget. When a number of separate docking stations are used in such an audio system and when each docking includes its own integrated audio mixer circuitry, the system power budget is increased because each docking station must run its audio mixer in order to present its output to the audio system, which is then mixed using an external audio mixer for presentation on the audio system. This type of system is not efficient in either its space or power usage.

Efficiency for mixing audio signals from one or more portable user devices in an audio system employing a number of docking station is achieved in accordance with the principles of the present invention wherein the docking station includes a controller for detecting the presence of an activated mixer associated with another docking station in the system. The controller activates its associated mixer when no activated mixer associated with another docking host in the system is detected. When its associated mixer is activated, the controller in the one docking station causes its associated mixer to be connected both to the audio sound system for supplying an input signal thereto and indirectly to the output(s) of the one or more portable devices.

Transfer of mixing from one docking station to another in the same system upon the occurrence of a particularly defined event is also achieved using the same controller. When an occurrence of the defined event is detected by the docking station, the docking station communicates with another docking station to effect transfer of the mixer thereto. The controller then deactivates the mixer in its associated docking station, while the other docking station activates its mixer. The newly activated mixer is controlled to connect to the audio sound system and to receive inputs indirectly from the docked portable devices. The controller of the one docking station routes audio signals from its docked portable device(s) to the newly activated mixer.

In all the embodiments, the docking stations are capable of communicating with each other over a communication path such as an inter-host communication bus or the like. Wireless and wired communications are capable of being used in this system.

The details of one or more implementations are set forth in the accompanying drawings and the description below. Even if described in one particular manner, it should be clear that implementations may be configured or embodied in various manners. For example, an implementation may be performed as a method, or embodied as an apparatus configured to perform a set of operations, or embodied as a computer readable medium storing instructions for performing a set of operations. Other aspects and features will become apparent from the following detailed description considered in conjunction with the accompanying drawings and the claims.

The above-mentioned and other features and advantages, and the manner of attaining them, will become more apparent and will be better understood by reference to the following description of embodiments of the invention taken in conjunction with the accompanying drawings, wherein.

Figure 1:
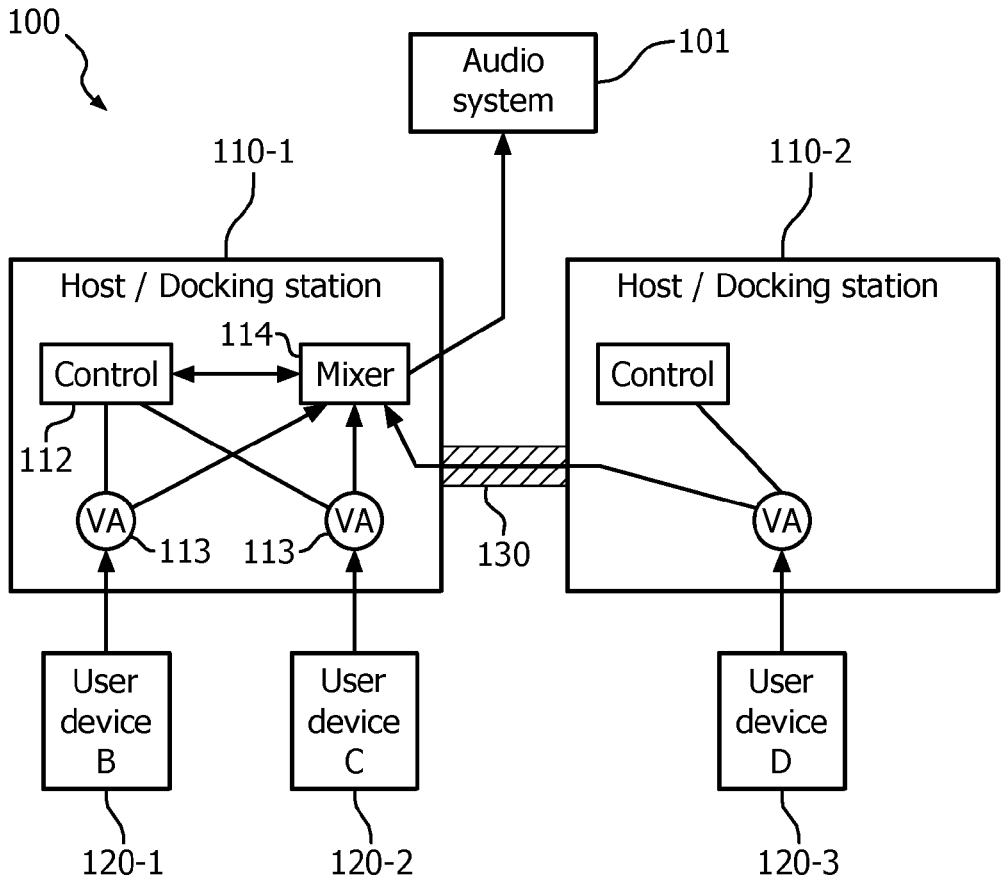
FIG. 1 depicts a system block diagram showing an audio system connected to portable devices via docking stations realized in accordance with the principles of the present invention.

The exemplary embodiments set out herein illustrate preferred embodiments of the invention, and such exemplary embodiments are not to be construed as limiting the scope of the invention in any manner.

Wireless docking employs wireless communication technology to provide a typically fixed or stationary docking environment for portable devices such as mobile phones, portable computers, other smart devices, and the like. The wireless docking environment gives the portable device 120 access, via the docking stations 110, to systems and peripheral devices, such as audio system 101, a display screen, a keyboard, a mouse, storage media, and input/output ports, for example, any and all of which can be used to improve the experience and the productivity of the applications for the docked portable device. The docking station may even afford the portable device access to a network (not shown), such as a wired or wireless local area network (LAN), wherein docking station 120 is connected wirelessly via the associated docking station 110 to client devices (not shown) in the local network via an access point (not shown).

Portable user device 120 is sometimes called a dockee or wireless dockee. The docking station 110 can also be referred to as a wireless docking host or simply as a host. Docking between the dockee and the docking station may be wireless or wired. The connection lines shown in the figures are intended to represent a form of communicative coupling between the devices and are intended to be realized as wireless or wired connections. Systems and peripherals, such as audio sound system 101, are generally connected to the docking station via input/output ports in some communicative manner, such as a wired connection or a wireless connection or pairing.

The term "wireless docking environment" may be used in the following description. It is intended to include the wireless docking station as well as any peripherals, devices, input or output ports, systems, networks, or the like that are connected to, or accessible from, the docking station.

Wireless communication technologies such as Bluetooth and Wi-Fi, including Wi-Fi Direct, can provide all or part of the communication capability required for the successful operation of wireless docking and undocking between the portable device and the docking station. For certain applications, one wireless communication technology may have an advantage over other available techniques. For example, Bluetooth would appear to possess insufficient bandwidth for enabling high-quality, low-latency, remote display output and generic access to USB peripherals. It may therefore be advantageous under certain conditions to use a combination of Bluetooth and Wi-Fi Direct for enabling different aspects of wireless docking and undocking.

Wi-Fi Direct, which is also known as Wi-Fi Peer-to-Peer (P2P), is a new communication standard for establishing peer-to-peer Wi-Fi connections between devices without the need for an external wireless access point. In the wireless docking regime, Wi-Fi Direct can be used as the primary connection and communication path between the portable device and a docking station. These communication technologies are exemplary technologies for use in the realization of the wireless docking system described herein. Other technologies may also be employed without departing from the principles of this invention. For example, it should be understood that additional communication technologies including Bluetooth Low Energy (BTLE) and MIMO antenna systems may be employed in the practice of all the inventive techniques described herein.

Exemplary simplified realizations of a portable device 120 and a docking station 110 are shown in co-pending U.S. Patent Application Ser. No. 61/563,141 filed on Nov. 23, 2011 and entitled, "Method and Apparatus for Configuration and Control of Wireless Docking", which is expressly incorporated by reference in its entirety herein. The portable device 120 includes a transceiver (not shown), a processor/controller 212, a memory (not shown) suitable for storing configuration information, driver information, and device applications, and an antenna (not shown). All these elements are shown in the above-identified, expressly incorporated co-pending application. Device control and operation is provided via controller processor, which is connected between the transceiver and the memory. The transceiver provides the radio capabilities including transmission and reception. It is connected to antenna. While one antenna is suitable for many applications, it will be understood that portable device may include more than one antenna operating in a single or even dual mode capacity. The portable device applications also include, but are not limited to, a docking procedure, an undocking procedure, and procedures related to audio mixing, including detections, activation, and transferring audio mixing among docking stations connected to an audio sound system, for example. Audio signal mixing may also be provided by a dedicated controllable mixer element within the portable user device.

Docking station 110 includes a transceiver (not shown), a processor/controller 112, a memory (not shown) suitable for storing configuration information, driver information, and device applications, input/output ports (not shown), and an antenna (not shown). All these elements are shown in the above-identified, expressly incorporated co-pending application. Docking station control and operation is provided via controller processor, which is connected between the transceiver and the memory. The transceiver provides the radio capabilities including transmission and reception for the docking station. It is connected to antenna. While one antenna is suitable for many applications, it will be understood that docking station 110 may include more than one antenna operating in a single or even dual mode capacity. The docking station applications also include, but are not limited to, a docking procedure, an undocking procedure, and procedures related to audio mixing, including detections, activation, and transferring audio mixing among docking stations connected to an audio sound system, for example. Audio signal mixing may also be provided by a dedicated controllable mixer element within the docking station. Since the docking station allows connection to peripherals and systems, such as audio sound system 101 via the input/output ports, the docking station memory will also include drivers for establishing and maintaining the connection to each peripheral. Input/output ports provides a sufficient number of connection ports, such as input ports and output ports and bidirectional ports, for connecting peripheral devices in the wireless docking environment. While the connection line between the output port of the docking station and the input of audio sound system is shown as a solid line, it will be understood that this connection may be accomplished via a wireless or wired connection or by pairing, as described above.

Procedures for docking and undocking of the portable user devices to the docking stations are well known in the art and will not be described in detail herein. An exemplary process for docking and undocking is described in the aforementioned co-pending patent application expressly incorporated by reference herein. The portable device is considered to be "docked"—that is, the portable device is in a docked state—when it has access via the docking station to one or more of the devices such as audio system 101, which are considered as a part of the wireless docking environment selected for docking. When it is desired to disconnect the portable device from the wireless docking environment, an undocking action is initiated. The portable device is considered to be "undocked"—that is, the portable device is in an undocked state—when the portable device no longer has access to, or a connection with, those same peripheral devices via the docking station.

For completeness, it is useful to distinguish between the concepts of physical docking versus logical docking. When a portable device is laying on a docking pad, or when it is positioned in a cradle, or when it has been placed by the user inside an area—whether physically demarcated or simply known to exist within certain boundaries—that is associated with a docking station or docking environment, it can be said that the portable device is physically docked to the docking station. Once a portable device enters the state of being physically docked, it is possible for this occurrence to trigger a docking action, which would result in the portable device also becoming logically docked. Removal of the portable device from the state of being physically docked may not necessarily result in the portable device being removed from its logically docked state.

Physical docking could be done by a user for any number of reasons, some of which may apply concurrently. Obviously, physical docking may be performed to initiate a logical docking Physical docking may also be performed in order to ensure that the portable device is connected to a power source for wired (contact-based) or wireless (contactless) charging as is accomplished by placing a phone on a charging pad or into a charging cradle, for example. Further, physical docking may be performed to enhance the quality of the communication channel between the portable device and the one or more docking stations, and ultimately between the portable device and the peripherals which are connected via the docking station(s). Proximity of the portable device to the docking station can improve signal quality (i.e., SNR or the like), communication speed and latency, and the like. Finally, physical docking can be viewed as an input to a security mechanism in the docking station so that the docking process can proceed more securely and/or so that the docking process can omit some security dialog steps that the user would have to go through otherwise when logically docking from a distance. Placement of the portable device onto a docking pad or into a docking cradle can be interpreted as a sign of trust by the portable device and by the docking station. Security dialog steps may include pin code authentication or password or challenge exchanges or the like between the portable device and the docking station.

Detection of physical docking can be provided either by the docking station or by the portable device or by a combination of operations performed by both of these devices. Detection can be performed by a detection element in the docking station employing a mechanical sensor or an electrical sensor, whether via electrical contact or via wireless means, to detect the physically docked presence of the portable device.

Audio output system 101 is present at a location L. The audio sound system 101 is capable of receiving input audio signals from another device over a connection, such as a connection using analog audio cables or a connection providing streaming audio over a network. Typically, without additional capabilities, the audio sound system can output audio received over one such connection at a time.

As shown in FIG. 1, one or more users 120-1 through 120-3 may be present at location L together with one or more host docking stations 110-1 and 110-2. The portable devices dock with the host docking station and then act as audio sources by sending audio to A over a connection to the audio sound system. The present invention minimizes the inconvenience to users that is associated with managing audio playback, in particular, the inconvenience when the audio is switched from one source to a different source. Additionally, the present invention establishes procedures for dealing with situations in which one or more of the portable user devices providing audio input to the audio systems are removed from location L, or are not present at location L, or are simply switched into an off state, or are in a low power standby or hibernation state. This eliminates any need for coordination by the users for handover of audio connections when any of these defined events take place. The present invention takes advantage of certain shared properties of the audio system or peripherals in the docking environment at location L.

The present invention will be described below in the exemplary context of wireless docking When present at location L, portable user devices B, C, and D connect to the audio sound system 101 indirectly by individually docking with its own docking environment on the associated host/docking station where the audio sound system is effectively present as a virtual 'shared' device VA 113. While the description of the invention herein is based primarily on the premise that each portable device docks with a particular docking station supporting a single docking environment (see for example docking station 110-2), it is understood that a docking station may support several concurrent docking environments as shown by docking station 110-1, where each user device is docked in its own docking environment resident on the single docking station. The presence of multiple docking environments on a single docking station is afforded by the use of joint configuration files to establish these entities.

An exemplary embodiment realized in accordance with the principles of the present invention is shown in FIG. 1. FIG. 1 shows a block diagram of a system 100 for mixing audio signals from one or more portable user devices 120 docked in said system via docking hosts 110, so that the mixed signals can be input to and presented on an audio sound system 101. It is assumed for the ease of description that audio sound system 101 is typically capable of reproducing the audio signals from only one source at a time. The mixed audio signals output by the mixer in the one docking host in the present embodiments are considered to emanate from a single audio source, even though they were ultimately produced by the one or more docked portable user devices.

In system 100, there are at least two docking hosts 110 that are communicatively coupled to the audio sound system 101 and to each other. Communicative coupling among the docking hosts is handled over a connection 130. Connection 130 may be realized as an inter-host communication bus, either wired or wireless. In a preferred implementation, connection 130 can be realized by a Wi-Fi backbone infrastructure network. The inter-host communication bus could be realized as the same Wi-Fi connection that provides Internet access to wireless and other networked devices at location L. Other implementations known to persons skilled in this technical field are contemplated for the inter-host communication bus.

In addition to the previously described elements comprising docking host 110, each docking host 110 includes elements for creating at least one virtual presence of the audio sound system for each individual portable user device docked with the docking host (e.g., VA 113), for mixing the audio output signals together as an input for the audio sound system 101 (e.g., mixer 114), and for detecting the presence of an activated mixing means associated with another docking host in the system 100 (e.g., control 112).

Virtual audio sound system presence 113 is created within the docking host when a portable user device 120 docks with the docking host. In the example shown in FIG. 1, separate virtual presences 113 for the audio sound system 101 are created in the docking hosts for each separate docking environment. Portable device 120-1 (B) docks with docking host 110-1 in the docking environment including the leftmost VA 113 so that the output audio signals from portable device 120-1 are coupled to that instantiation of VA 113. Portable device 120-2 (C) docks with docking host 110-1 in the docking environment including the rightmost VA 113 so that the output audio signals from portable device 120-2 are coupled to that instantiation of VA 113. Portable device 120-3 (D) docks with docking host 110-2 in the docking environment including its own instantiation of VA 113 so that the output audio signals from portable device 120-3 are coupled to that instantiation of VA 113. Each docking host 110 completes the coupling of the portable device output audio signals to the proper instantiation of the virtual presence 113 of audio system 101 in the associated docking environment.

Virtual audio presence VA 113 is defined to represent to the docked user devices an audio output interface to the actual audio sound system 101, where this output interface includes 'mixing/shared' semantics. The 'shared' part of these semantics implies that each portable user device 120 can all simultaneously share the same functionality as is present for a single device connected directly to the audio system. In other words, each portable user device is provided the capability to be able to produce sound on the audio output device 101, even though the audio system itself may not have been realized in such a way to allow such shared use in the absence of wireless docking The 'mixing' part of these semantics means that the audio system is shared by mixing (adding) the audio signals from all portable user devices together, so that simultaneous audio signals can all be heard at the same time, if desired. It should be understood that, if one were to produce an actual representation of VA in a user interface or user manual, the technical terms herein such as "mixing/shared semantics" would more likely be substituted for by more simple, and possibly less precise, terms or pictograms that could convey to the user that a virtual audio device VA exists in a docking environment and is associated with a particular actual audio sound system 101. In some embodiments, the docking system may be able to group several separate audio output devices together to function as a single audio sound system 101 that is associated with all devices VA. For example, one such grouping or integration of separate audio devices can be realized by grouping the speakers of a TV and the speakers of a 'home theater' style stand-alone audio system together into a more robust sound system. It is contemplated that VA 113 includes the functionality of audio system 101 so that muting, volume control, equalization, and other such functions are provided to each user device for use with its output audio signals.

Mixer 114 is controllably activated by controller 112. Typically, the mixer in docking host 110 is utilized to mix together audio signals from one or more portable user devices connected to the various docking hosts 110 in order to generate an input audio signal for audio sound system 101. Docking host 110-2 and other docking hosts (not shown) at location L also include controllably activated mixers which are in an inactivated or deactivated state, so that they do not appear in the block diagram of docking station 110-2. In the event that a mixer is activated in a particular docking host, that mixer is capable of being controllably coupled to the audio system 101. If the mixer is not activated, it is not coupled to the audio system 101.

In the exemplary embodiment shown in FIG. 1, mixer 114 combines the output audio signals from portable user devices B (120-1), C (120-2), and D (120-3). Connections are made controllably between the portable devices and their specific VAs 113. The audio signal from portable user device D (120-3) is shown as being conveyed through inter-host communication bus 130 from docking host 110-2 to docking host 110-1, so that it can ultimately be connected to mixer 114 in docking host 110-1.

Control 112 is referenced in this description as a control element or as a controller. Control 112 is employed for detecting the presence of an activated mixing element associated with another docking host in system 100. In other words, control 112 in docking host 110-1 detects whether an active instantiation of mixer 114 is present in any of the other docking hosts 110-2 and so on at location L. Control 112 also activates its associated mixer 114 when no activated mixer 114 is detected in the other docking hosts in said system. Hence, when control 112 in docking host 110-1 fails to detect the presence of an active mixer 114 in any of the other docking hosts, such as host 110-2 and so on, in system 100, control 112 controllably activates mixer 114 in docking host 110-1. In response to activating its associated mixer 114 in docking host 110-1, the control 112 causes mixer 114 in the associated docking host 110-1 to be connected both to the audio sound system 101 for supplying the input signal thereto and to an output of the at least one virtual presence of the audio sound system VA 113 within the associated docking host 110-1.

Control 112 is also used for suppressing activation of its associated mixing element 114 when a mixer 114 is found to be activated in another docking host, other than the associated docking host, communicatively coupled to the audio sound system 101. In response to detection of the mixer 114 being activated in some other docking host in system 100, control 112 causes the output from the at least one virtual presence VA 113 in the associated docking host, docking host 110-1, for example, to be communicatively coupled to the mixer 114 that was detected as being active.

When a last portable user device is initiating an undocking from the associated docking host or powering down while remaining connected to the docking host, or when the docking host is powering down to a low sleep power or to an off state, it may become necessary to transfer mixing from the affected docking host to another docking host in system 100. Control 112 detects whether the one or more portable user devices 120 are initiating an undocking from the docking host 110 associated with the control 112. In response to detection of an occurrence of at least one defined event, such as those mentioned above, control 112 is further adapted to communicate with another docking host via inter-host communication bus 130 in order to effect a transfer of mixing. For completeness, it should be noted that the defined events include at least one of: detection of a last portable user device initiating an undocking from the associated docking host, detection of a last portable user device initiating a powering down (such as a powering down to a low power sleep mode or completely powering down to an off state) while remaining connected to the associated docking host, and detection of a powering down of the associated docking host to a low power or off state. When one or more of these events is detected and the mixer is active for the docking host, control 112 deactivates and decouples the associated mixer 114 from audio system 101 in response to the other docking host controllably activating its mixer 114 and controllably coupling the mixer output to the audio system. In this way, mixing is transferred by an automatic handover mechanism controlled by the docking hosts in system 100 without any user intervention. This technique provides for system resource conservation, power savings, and system efficiencies not provided by the prior art systems.

Figure 2:
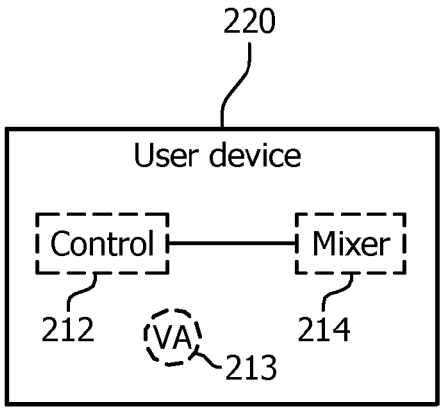
FIG. 2 shows a detailed representation of an optional portable device for use in the system shown in FIG. 1.

As shown in FIG. 2, the control 212, virtual presence 213 of the audio system 101, and mixer 214 may all be realized in one or more portable user devices 220. These elements operate in substantially the same manner as their counterpart elements described above in docking hosts 110. When the portable device having this additional functionality is docked with a docking host having the same or similar functionality, it is contemplated that the docking host or the portable device may provide all the functionality or share complementary portions to comprise the entire functionality for the system as described above.

The operation of the inventive elements may be better understood with reference to an exemplary scenario. Location L for system 100 may be a family room or living room, where audio sound system 101 is a high-quality sound system, either integrated into a home theater, a large television system or a stand-alone sound system. In this setting, it is assumed for this example that there are a number of people in the room and that each person has their own portable device that can play audio. For example, these individuals may have a smart phone, a laptop or net book computer, tablet PC, an MP3 player, or the like. Occasionally, one of these people may desire to share multimedia content with others in the room by playing a music video found on the Internet for everyone, where the audio portion of the multimedia content is then played over the high-quality sound system 101, for example. In such an exemplary situation, the image portion of that multimedia content for the music video might be shared by having all the people watch the tablet PC of the person who found the video.

It is assumed that no portable device is docked in system 100 at the outset and it is also assumed that the docking hosts 110-1 and 110-2 are in a low power or sleep mode. When the person wishing to show the music video enters the room, that person attempts to dock the portable user device 120-1 into docking environment E1 on docking host 110-1. Device 120-1 wakes up docking host 110-1 and docks with E1 via docking host 110-1. Host 110-1 sets up the virtual presence of audio system 101 as VA 113 in docking environment E1. Then docking host 110-1 uses the inter-host communication bus 130 to detect whether any other host 110-2 or the like has already created a mixer 114 therein. Either by receiving a response from one or more of the other docking hosts or, when a docking host is in a low power sleep mode, by receiving no response, the docking host 110-1 detects that there is no mixer 114 activated on any other host in system 100 at location L. In turn, docking host 110-1 controllably activates mixer 114 itself and controllably connects the mixer to the audio system 101 and to the audio output signals from the virtual presence VA 113 of audio system 101. In this way, the audio portion of the music video on portable device 120-1 is able to be presented by the audio system 101 for everyone's enjoyment.

When the person with portable device D (120-3) enters location L, he desires to dock his device with environment E3 because it apparently includes a peripheral device or system or network that is not available in docking environment E1 or E2, both in docking host 110-1. Portable device D then proceeds to wake up docking host 110-2 in order to dock in environment E3 on docking host 110-2. Host 110-2 sets up the virtual presence of audio system 101 as VA 113 in docking environment E3. Then, docking host 110-2 uses the inter-host communication bus 130 to detect whether any other host 110-1 or the like has already created a mixer 114 therein. At this point, docking host 110-1 has already activated mixer 114 therein and responds to docking host 110-2 accordingly. Upon detecting the presence of an activated mixer in another docking host, docking host 110-2 simply connects the output of VA 113 in environment E3 to mixer 114 in docking host 110-1 via the inter-host communication bus 130.

In the event that portable device C attempts to dock with docking environment E2 in docking host 110-1, its audio output will be connected to mixer 114 via VA 113 in docking environment E2 because docking host 110-1 will detect that the mixer is activated in itself. The audio signal from portable device C will be mixed with the audio output signal from portable devices B and D.

It is now assumed that portable device C has already undocked from docking host 110-1 and that portable device B is attempting to initiate an undocking from (or a powering down on) docking host 110-1, while portable device D is still docked with docking host 110-2. At this point, docking host 110-1 detects that it no longer has (active) portable users connected to itself, with the exception that docking host 10-2 is still using mixer 114 in docking host 110-1. Docking host 110-1 therefore communicates to docking host 110-2 that it wants to transfer the mixer to the latter host. Docking host 110-2 responds by closing its connection on mixer 114 in docking host 110-1 from VA 113 in environment E3 on docking host 110-2. Docking host 110-1 then removes the connection from mixer 114 to audio system 101, shuts down the operation of its mixer 114 therein, and removes the connection between mixer 114 and VA 113 in environment E1 connected to portable device 120-1 (B), not necessarily in the order presented herein. Docking host 110-2 activates mixer 114 in itself and connects the output of mixer 114 to audio system 101. Docking host 110-2 then connects the virtual presence of the audio system VA 113 in docking environment E3 on this same docking host to the newly activated mixer 114 on this host. As these operations are being completed, docking host 110-1 is also able to power down into a low power sleep mode. In this scenario, the portable user device D may experience a short interruption in audio reproduction, but this is considered acceptable as it enables an energy savings and a system resource savings.

In the exemplary scenario described above, it can also be assumed that docking host 110-1 determines that it can enter at least a low power sleep mode in order to save energy, while portable user device B remains active and connected thereto. In this revised scenario, docking host 110-1 must disconnect VA 113 in docking environment E1 for portable device B from mixer 114 as it is deactivated in docking host 110-1 and then it must cause the output of VA 113 in docking environment E1 to be connected to the newly activated mixer 114 in docking host 110-2. In each of these scenarios, it is ensured that the audio system 101 is never faced with two simultaneous connections or connection attempts—a result that is beneficial especially when the audio system 101 is an UPnP device.

In the operation of the system 100, it is believed to be beneficial for docking hosts to coordinate among each other for ensuring that only a single connection or connection attempt to such an UPnP device is made at any single time. This will maintain predictable operation for such a system because the standards governing UPnP do not clearly and exactly define what happens when two devices try to send audio to a single UPnP device at the same time, such as when one docking host attempts to make an network connection and send audio to a UPnP audio sink while, at the same time, another docking host has an already established connection with the UPnP device (such as audio system 101) and is sending audio to it. A UPnP device might reject the connection attempt by the one docking host, but it might also stop accepting data from the established connection with the first docking host, or it might even mix the two audio streams together. The answer is not clear. That is why the present invention is able to avoid any uncertainties by maintaining the above-described protocol among docking hosts.

Figure 3:
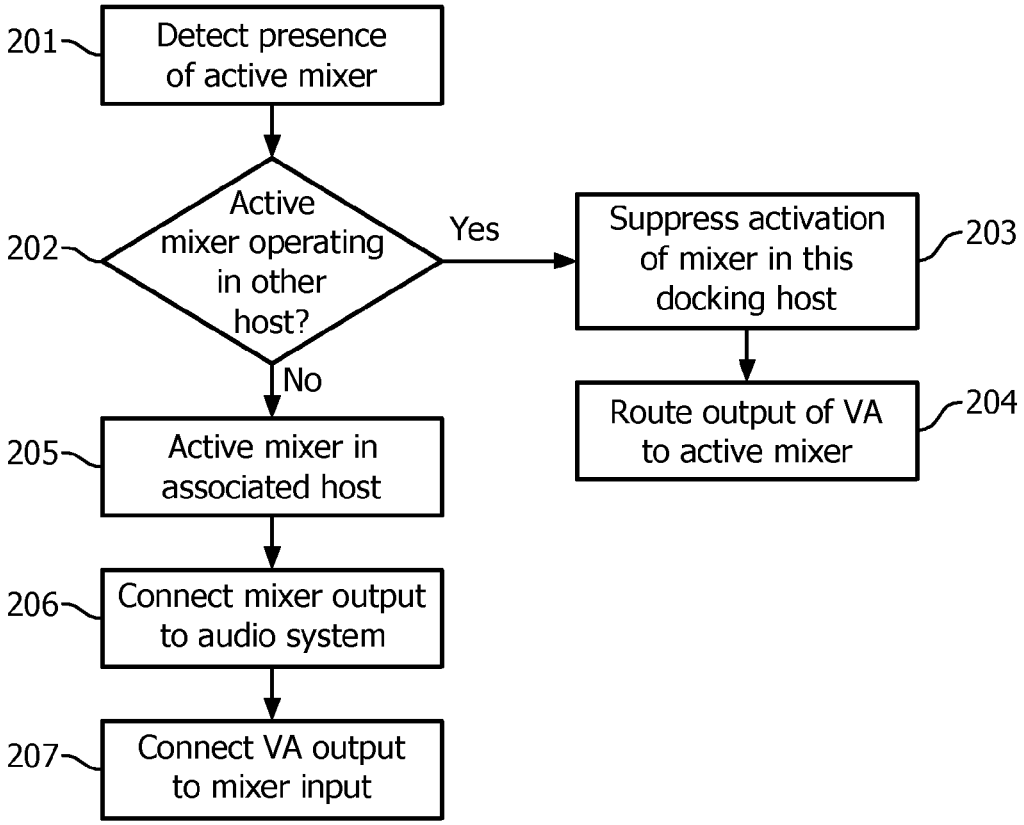
FIGS. 3 and 4 show exemplary methods for use in detecting, activating, and transferring an active mixer function among the docking stations and docked portable user devices in the system of FIG. 1.
Figure 4:
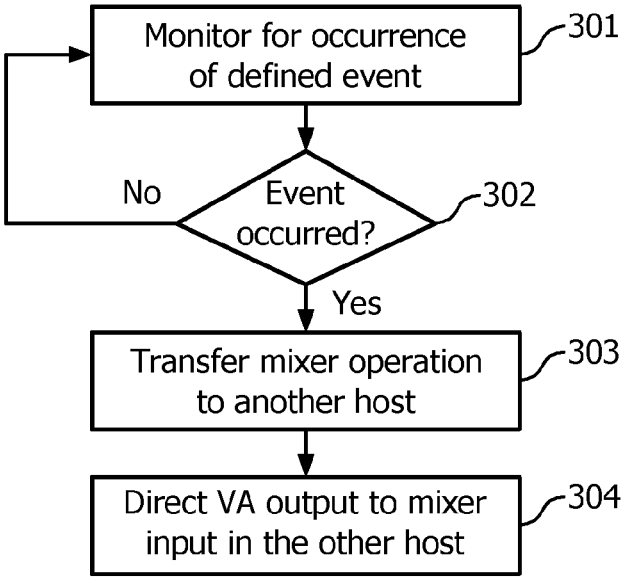

Exemplary methods embodying the principles of the present invention are shown in FIGS. 3 and 4 and are described below. Additional details about the steps performed in each of the methods depicted in the figures can be obtained from the description of the specific system elements described above in relation to FIGS. 1 and 2.

In step 201, the presence of an active mixer in the current or any other docking host is detected by the current docking host. When the active mixer is detected in a host different from the current host, step 202 causes control of the method to be directed to step 203. If no active mixer is detected in a docking host different from the current host (or when the active mixer is detected in the current docking host), step 202 causes control of the method to be directed to step 205.

In step 203, activation of the mixer is suppressed in the current docking host. The output audio signal from the virtual presence VA for the audio system on the current host is routed to the input of the detected active mixer on the other docking host in step 204. At this point, the process is ended until another portable user devices docks to the system.

In step 205, provided that the mixer in the present docking device has not already been activated, the mixer in the present docking device is activated. In step 206, the newly activated mixer is connected to an input of the audio system, unless this mixer was already activated. In step 207, the output of virtual presence VA for the audio system on the current host is connected to the mixer input. At this point, the process is ended until another portable user devices docks to the system.

In step 301, the occurrence of a defined event is detected. The defined events have been described above. They include undocking or powering down of a portable user device and powering down a docking station into a low power sleep mode. If a defined event has not occurred, step 302 returns control to step 301. If a defined event has occurred, then control is transferred to step 303.

In step 303, the current docking host that detected the event occurrence transfers the mixer operation from itself to another host. At this point, the mixer is deactivated and disconnected, both its input(s) and output, in the current docking host and a new mixer is activated in the other docking host. In step 304, when the portable device on the current docking host remains active, its mixer input signal is routed to the mixer in the other host. When the portable device on the current docking host is undocked or becomes inactive by powering down, no rerouting of signals is required from the current host to the other host. In this latter case, only the mixer input signals from the other host(s) are connected, and possibly rerouted to, the newly activated mixer.

The docking station may be, or may include, a cradle that completely or partially conforms to the contours of the portable device. The docking station may be realized as an electronic pad or surface suitable for accepting the placement of one or more portable devices. Such a pad can be realized similarly to wireless charging pads which are presently commercially available. When the portable device is placed on or near the pad surface, it can be docked with the docking station.

In addition, the docking station may be realized as a fully integrated device or it may be separated into several components such as a cradle and a main section. In this embodiment, the main section of the docking station may utilize internal or external hardware and software such as a personal computer or the controller/processor and memory or the like in order to provide device intelligence, operations, and peripheral connectivity. Peripheral connectivity may be realized as a wired or wireless communication connection.

The docking station may include a charging element to replenish the power in the portable device. Charging may be performed via either a wired (contact based) or wireless (contactless) coupling with the portable device.

All examples and conditional language recited herein are intended for pedagogical purposes to aid the reader in understanding the present principles and the concepts contributed by the inventors to furthering the art, and are to be construed as being without limitation to such specifically recited examples and conditions. Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It will be appreciated by those skilled in the art that the block diagrams presented herein represent conceptual views of illustrative system components and/or circuitry embodying the principles of the present invention. Similarly, it will be appreciated that any flow charts, flow diagrams, state transition diagrams, pseudo code, and the like represent various processes which may be substantially represented in computer readable media and so executed by a computer or processor, whether or not such computer or processor is explicitly shown.

The functions of the various elements shown in the figure may be provided through the use of dedicated hardware as well as hardware capable of executing software in association with the appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor ("DSP") hardware, read-only memory ("ROM") for storing software, random access memory ("RAM"), and other non-volatile storage.

The methods described herein may be implemented by instructions being performed by a processor, and such instructions may be stored on a processor-readable medium such as, for example, an integrated circuit, a software carrier or other storage device such as, for example, a hard disk, a compact diskette, a random access memory ("RAM"), or a read-only memory ("ROM"). The instructions may form an application program tangibly embodied on a processor-readable medium. As should be clear, a processor may include a processor-readable medium having, for example, instructions for carrying out a process. Such application programs may be uploaded to, and executed by, a machine comprising any suitable architecture. Preferably, the machine is implemented on a computer platform having hardware such as one or more central processing units ("CPU"), a random access memory ("RAM"), and input/output ("I/O") interfaces. The computer platform may also include an operating system and microinstruction code. The various processes and functions described herein may be either part of the microinstruction code or part of the application program, or any combination thereof, which may be executed by a CPU. In addition, various other peripheral units may be connected to the computer platform such as an additional data storage unit and a printing unit.

It should be understood that the elements shown in the figures may be implemented in various forms of hardware, software, firmware, or combinations thereof. Preferably, these elements are implemented in a combination of hardware and software on one or more appropriately programmed general-purpose devices, which may include a processor, memory and input/output interfaces. Moreover, the implementations described herein may be implemented as, for example, a method or process, an apparatus, or a software program. Even if only discussed in the context of a single form of implementation (for example, discussed only as a method), the implementation of features discussed may also be implemented in other forms (for example, an apparatus or program). An apparatus may be implemented as mentioned above. The methods may be implemented in, for example, an apparatus such as, for example, a processor, which refers to processing devices in general, including, for example, a computer, a microprocessor, an integrated circuit, or a programmable logic device.

It is to be further understood that, because some of the constituent components and methods depicted in the accompanying drawings may be implemented in software, the actual connections between the system components or the process function blocks may differ depending upon the manner in which the present principles are programmed. Given the teachings herein, one of ordinary skill in the pertinent art will be able to contemplate these and similar implementations or configurations of the present principles.

A number of implementations have been described. Nevertheless, it will be understood that various modifications may be made. For example, elements of different implementations may be combined, supplemented, modified, or removed to produce other implementations. Additionally, one of ordinary skill will understand that other structures and processes may be substituted for those disclosed and the resulting implementations will perform at least substantially the same function(s), in at least substantially the same way(s), to achieve at least substantially the same result(s) as the implementations disclosed. In particular, although illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. Accordingly, these and other implementations are contemplated by this application and are within the scope of the following claims.

We claim:

1. A system for mixing audio signals from one or more portable user devices docked in said system, the system comprising:

an audio sound system;

at least two docking hosts communicatively coupled to each other, each said docking host including a processor configured to:

create at least one virtual presence of the audio sound system for each individual portable user device docked with said docking host, and couple an audio output signal from each individual portable user device to the virtual presence of the audio system with which the individual portable user device is associated;

responsive to an audio output signal from each of said one or more portable user devices docked in said system, mix the audio output signals together as an input for the audio sound; and detect a mixing associated with another docking host in said system, the processor being configured to active its associated mixing when no activated mixing associated with another docking host in said system is detected; and in response to activating its associated mixing, the processor is configured to supply the mixing as the input signal to the audio sound system and is configured to receive an output of the at least one virtual presence of the audio sound system within the associated docking host.

2. The system as defined in claim 1, wherein:

the processor in each said docking host is further configured to detect whether the one or more portable user devices or the associated docking host are initiating a defined event, in response to detection of an occurrence of at least one defined event, the processor is further configured to communicate with another docking host to effect a transfer of mixing, and the processor is configured to deactivate and decouple the associated mixing from said audio system in response to said another docking host controllably activating its mixing and controllably coupling to said audio system, wherein said defined event includes at least one of:

a last portable user device is initiating an undocking from the associated docking host, a last portable user device is initiating a powering down operation while remaining connected to the associated docking host, and powering down of the associated docking host to a low power or off state of operation.

3. The system as defined in claim 1, wherein the processor in the docking host suppresses activation of its associated mixing when another mixing is found to be activated in another docking host communicatively coupled to the audio sound system.

4. The system as defined in claim 3, wherein, in response to detection of said another mixing in said another docking host as being activated, the processor is further configured to cause the output from the at least one virtual presence in the associated docking host to be communicatively coupled to another processor detected as being activated for mixing in said another docking host.

5. The system as defined in claim 1, wherein the at least two docking hosts are communicatively coupled with each other via a backbone network.

6. The system as defined in claim 1, wherein at least one of said one or more portable user devices includes a second processor configured to:

create at least one virtual presence of the audio sound system for said at least one portable device docked with said docking host, and to couple an audio output signal from said at least one portable user device to the virtual presence of the audio system with which the individual portable user device is associated;

responsive to an audio output signal from each of said one or more portable user devices docked in said system, to mix the audio output signals together as an input for the audio sound system; and detect the presence of an activated mixing in another docking host or another portable user device in said system, the second processor being configured to activate its associated mixing when no activated mixing is detected; and in response to activating its associated mixing, said second processor being configured to supply the mixing as the input signal to the audio sound system and is configured to receive an output of the at least one virtual presence of the audio sound system.

7. A docking host for use in a system comprising an audio sound system and at least two docking hosts, wherein the docking host mixes audio signals from one or more portable user devices docked in said host for input to an audio system, the host comprising a processor configured to:

create at least one virtual presence of the audio sound system for each individual portable user device docked with said docking host, and couple an audio output signal from each individual portable user device to the virtual presence of the audio system with which the individual portable user device is associated;

responsive to an audio output signal from each of said one or more portable user devices docked in said system, mix the audio output signals together as an input for the audio sound; and detect the presence of an activated mixing associated with another docking host in said system, the processor being configured to activate its associated mixing when no activated mixing associated with another docking host in said system is detected; and in response to activating its associated mixing, the processor is configured to supply the mixing as the input signal to the audio sound system and is configured to receive an output of the at least one virtual presence of the audio sound system within the associated docking host.

8. The docking host as defined in claim 7, wherein:

the processor in said docking host is further configured to detect whether the one or more portable user devices or the docking host itself are initiating a defined event, in response to detection of an occurrence of at least one defined event, the processor is configured to communicate with another docking host to effect a transfer of mixing, and the processor is configured to deactivate and decouple the associated mixing from said audio system in response to said another docking host controllably activating its mixing and controllably coupling to said audio system, wherein said defined event includes at least one of:

a last portable user device is initiating an undocking from the associated docking host, a last portable user device is initiating a powering down operation while remaining connected to the associated docking host, and powering down of the docking host itself to a low power or off state of operation.

9. The docking host as defined in claim 7, wherein the processor in the docking host is configured to suppress activation of its associated mixing when another mixing is found to be activated in another docking host communicatively coupled to the audio sound system.

10. The docking host as defined in claim 9, wherein, in response to detection of the mixing in said another docking host as being activated, the processor is configured to cause the output from the at least one virtual presence in the associated docking host to be communicatively coupled to another processor detected as being activated for mixing in said another docking host.

11. The docking host as defined in claim 7, wherein the docking host is communicatively coupled with at least one other docking host via a backbone network.

12. A method for mixing audio signals from one or more portable user devices docked on at least two docking hosts for presentation on an audio sound system, wherein the at least two docking hosts are communicatively coupled to each other, the method comprising:

creating, in a docking host, at least one virtual presence of the audio sound system for each individual portable user device docked with said docking host, and coupling an audio output signal from each individual portable user device to the virtual presence of the audio system with which the individual portable user device is associated;

in a docking host, in response to an audio output signal from each of said one or more portable user devices docked in said system, mixing the audio output signals together as an input for the audio sound system, wherein said mixing is controllably activated;

detecting, in a docking host, the presence of an activated mixing associated with another docking host in said system, activating its associated mixing when no activated mixing associated with another docking host in said system is detected, and in response to activating its associated mixing, connecting said input to the audio sound system and supplying an output of the at least one virtual presence of the audio sound system within the associated docking host to said mixing.

13. The method as defined in claim 12, further including suppressing activation of the mixing by the associated docking host when another mixing is found to be activated in another docking host communicatively coupled to the audio sound system.

14. The method as defined in claim 13, wherein in response to detection of mixing in said another docking host as being activated, causing the output from the at least one virtual presence in the associated docking host to be communicatively coupled as an input to the mixing detected as being activated in said another docking host.

15. The method as defined in claim 12, wherein the methods further comprises:

detecting by the docking host whether the one or more portable user devices or the docking host itself are initiating a defined event, in response to detection of an occurrence of at least one defined event, communicating with another docking host to effect a transfer of mixing from the docking host to the another docking host, deactivating said mixing in the docking host, and decoupling the input from said audio system in response to said another docking host controllably activating mixing and controllably coupling the input generated by the another docking host to said audio system, wherein said defined event includes at least one of:

a last portable user device is initiating an undocking from the associated docking host, a last portable user device is initiating a powering down operation while remaining connected to the associated docking host, and powering down of the docking host itself to a low power or off state of operation.

16. A non-transitory computer-readable medium having one or more executable instructions stored thereon, which when executed by a processor, cause the processor to perform a method for mixing audio signals from one or more portable user devices docked on at least two docking hosts for presentation on an audio sound system, wherein the at least two docking hosts are communicatively coupled to each other, the method comprising:

creating, in a docking host, at least one virtual presence of the audio sound system for each individual portable user device docked with the docking host, and coupling an audio output signal from each individual portable user device to the virtual presence of the audio system with which the individual portable user device is associated;

in a docking host, in response to an audio output signal from each of the one or more portable user devices docked in the system, mixing the audio output signals as an input for the audio sound system, wherein the mixing is controllably activated;

detecting, in a docking host, the presence of an activated mixing associated with another docking host in the system;

activating its associated mixing when no activated mixing associated with another docking host in the system is detected; and in response to activating its associated mixing, connecting the input to the audio sound system and supplying an output of the at least one virtual presence of the audio sound system within the associated docking host to the mixing.

* * * * *